US010267016B2

(12) United States Patent
Friend et al.

(10) Patent No.: US 10,267,016 B2
(45) Date of Patent: Apr. 23, 2019

(54) SYSTEM AND METHOD FOR SWING CONTROL

(71) Applicant: Caterpillar Inc., Peoria, IL (US)

(72) Inventors: Paul Russell Friend, Morton, IL (US); Michael Edward Brandt, Racine, WI (US)

(73) Assignee: Caterpillar Inc., Deerfield, IL (US)

( * ) Notice: Subject to any disclaimer, the term of this patent is extended or adjusted under 35 U.S.C. 154(b) by 250 days.

(21) Appl. No.: 15/259,251

(22) Filed: Sep. 8, 2016

(65) Prior Publication Data

US 2018/0066413 A1 Mar. 8, 2018

(51) Int. Cl.

| | |
|---|---|
| ***E02F 9/12*** | (2006.01) |
| ***G01B 21/16*** | (2006.01) |
| *E02F 3/30* | (2006.01) |

(52) U.S. Cl.

CPC ..... *E02F 9/123* (2013.01); *G01B 21/16* (2013.01); *E02F 3/308* (2013.01)

(58) Field of Classification Search

CPC ..... E02F 9/123; E02F 3/30; G01B 21/16
See application file for complete search history.

(56) References Cited

U.S. PATENT DOCUMENTS

| | | | | |
|---|---|---|---|---|
| 5,065,326 | A | 11/1991 | Sahm | |
| 6,108,949 | A | 8/2000 | Singh et al. | |
| 6,363,632 | B1 | 4/2002 | Stentz et al. | |
| 6,988,591 | B2 | 1/2006 | Uranaka et al. | |
| 7,578,079 | B2 | 8/2009 | Furem | |
| 8,768,579 | B2 | 7/2014 | Taylor et al. | |
| 8,768,583 | B2 | 7/2014 | Hargrave, Jr. et al. | |
| 2009/0216410 | A1 | 8/2009 | Allen et al. | |
| 2010/0106415 | A1 | 4/2010 | Pierz et al. | |
| 2012/0263566 | A1* | 10/2012 | Taylor | E02F 3/437 414/694 |
| 2013/0245897 | A1 | 9/2013 | Linstroth et al. | |
| 2015/0308070 | A1 | 10/2015 | Deines | |

FOREIGN PATENT DOCUMENTS

| | | |
|---|---|---|
| EP | 2911101 | 8/2015 |

* cited by examiner

*Primary Examiner* — Anne M Antonucci
*Assistant Examiner* — Renee LaRose
(74) *Attorney, Agent, or Firm* — L. Glenn Waterfield

(57) ABSTRACT

A swing control assembly for a first machine is provided. The swing control assembly includes a position detection module configured to generate a signal indicative of a relative position of a second machine with respect to the first machine. The swing control assembly includes a controller communicably coupled to the position detection module. The controller is configured to receive the signal indicative of the relative position of the second machine with respect to the first machine. The controller is configured to determine a direction of swing associated with the first machine based on the received signal. The controller is configured to provide an instruction to initiate a swing operation of the first machine based on the determined direction of swing.

20 Claims, 5 Drawing Sheets

SYSTEM AND METHOD FOR SWING CONTROL

TECHNICAL FIELD

The present disclosure relates generally to an automated system, and more particularly, to a system and method for swing control of a machine.

BACKGROUND

Industrial machines, for example electric rope or power shovels, draglines, etc., are used to execute digging operations to remove material from worksites or mines. An operator controls a rope shovel during a dig operation to load a dipper with material. The operator deposits the material from the dipper into a haul truck. After depositing the material, a dig cycle of the rope shovel continues and the operator swings the dipper back to perform additional digging.

A swing control mechanism is associated with the dipper of the rope shovel, such that a swing operation of the dipper may be automatically controlled. A swing direction of the dipper may change based on a position of the haul truck. Accordingly, for every new loading operation, generally a user needs to input the direction of swing for the rope shovel, thereby indicating that the dig operation is complete.

Hence, until the operator provides the input, subsequent swing operations may not be carried out by the rope shovel. This may affect overall productivity and efficiency of the system, due to reliance on the operator to act in a timely manner. Further, waiting for these inputs by the operator may lead to increased time in performing allotted tasks due to higher wait time based on varying operator input efficiency.

U.S. Pat. No. 6,363,632 describes a system to organize and coordinate components associated with earthmoving machinery. The system comprises an earthmoving machine equipped with a scanning sensor system operable to provide data regarding regions within an earthmoving environment including an excavation region and a loading region and a planning and control module operable to receive data from the scanning sensor system to plan a task associated with the control of the earthmoving machine while concurrently performing another task associated with control of the earthmoving machine.

SUMMARY OF THE DISCLOSURE

In one aspect of the present disclosure, a swing control assembly for a first machine is provided. The swing control assembly includes a position detection module configured to generate a signal indicative of a relative position of a second machine with respect to the first machine. The swing control assembly includes a controller communicably coupled to the position detection module. The controller is configured to receive the signal indicative of the relative position of the second machine with respect to the first machine. The controller is configured to determine a direction of swing associated with the first machine based on the received signal. The controller is configured to provide an instruction to initiate a swing operation of the first machine based on the determined direction of swing.

In another aspect of the present disclosure, a method for controlling a swing of a first machine is provided. The method includes receiving, by a controller, a signal indicative of a relative position of a second machine with respect to the first machine from a position detection module. The method includes determining, by the controller, a direction of swing associated with the first machine based on the received signal. The method includes providing, by the controller, an instruction to initiate a swing operation of the first machine based on the determined direction of swing.

In yet another aspect of the present disclosure, a machine is provided. The machine includes an engine and a swing control assembly. The swing control assembly includes a position detection module configured to generate a signal indicative of a relative position of a second machine with respect to the machine. The swing control assembly also includes a controller communicably coupled to the position detection module. The controller is configured to receive the signal indicative of the relative position of the second machine with respect to the machine. The controller is configured to determine a direction of swing associated with the machine based on the received signal. The controller is configured to provide an instruction to initiate a swing operation based on the determined direction of swing.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
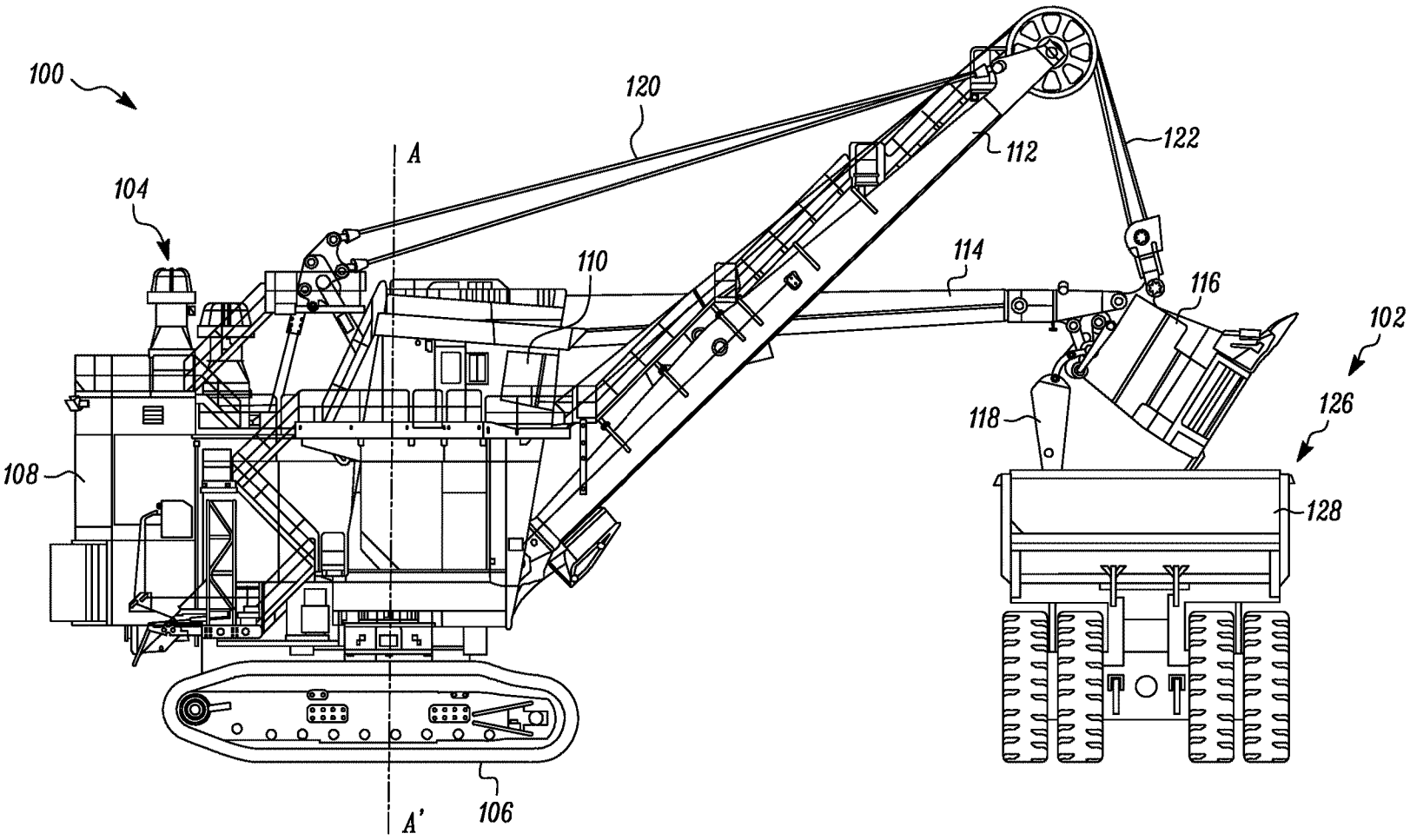
FIG. 1 is a side view of two exemplary machines, according to one embodiment of the present disclosure.

Referring to FIG. 1, two exemplary machines including a first machine 100 and a second machine 102 are illustrated. The first machine 100 is an exemplary rope shovel 104. The first machine 100 includes tracks 106 for propelling the first machine 100 forward and backward, and for turning the first machine 100. The turning of the first machine 100 includes varying a speed and/or a direction of left and right tracks relative to each other. The tracks 106 support a base 108 including a cab 110. The base 108 is able to swivel about a swing axis A-A', for instance, to move from a digging location to a dumping location. Movement of the tracks 106 is not necessary for the swing motion. The first machine 100 further includes a boom 112 supporting a pivotable dipper handle 114 and the dipper 116. The dipper 116 includes a dipper door 118 for dumping contents within the dipper 116.

The first machine 100 also includes taut suspension cables 120 coupled between the base 108 and the boom 112 for supporting the boom 112; a hoist cable 122 attached to a winch (not shown) within the base 108 for winding the hoist cable 122 to raise and lower the dipper 116; and a crowd cable (not shown) attached to another winch (not shown) for extending and retracting the dipper 116.

Figure 2:
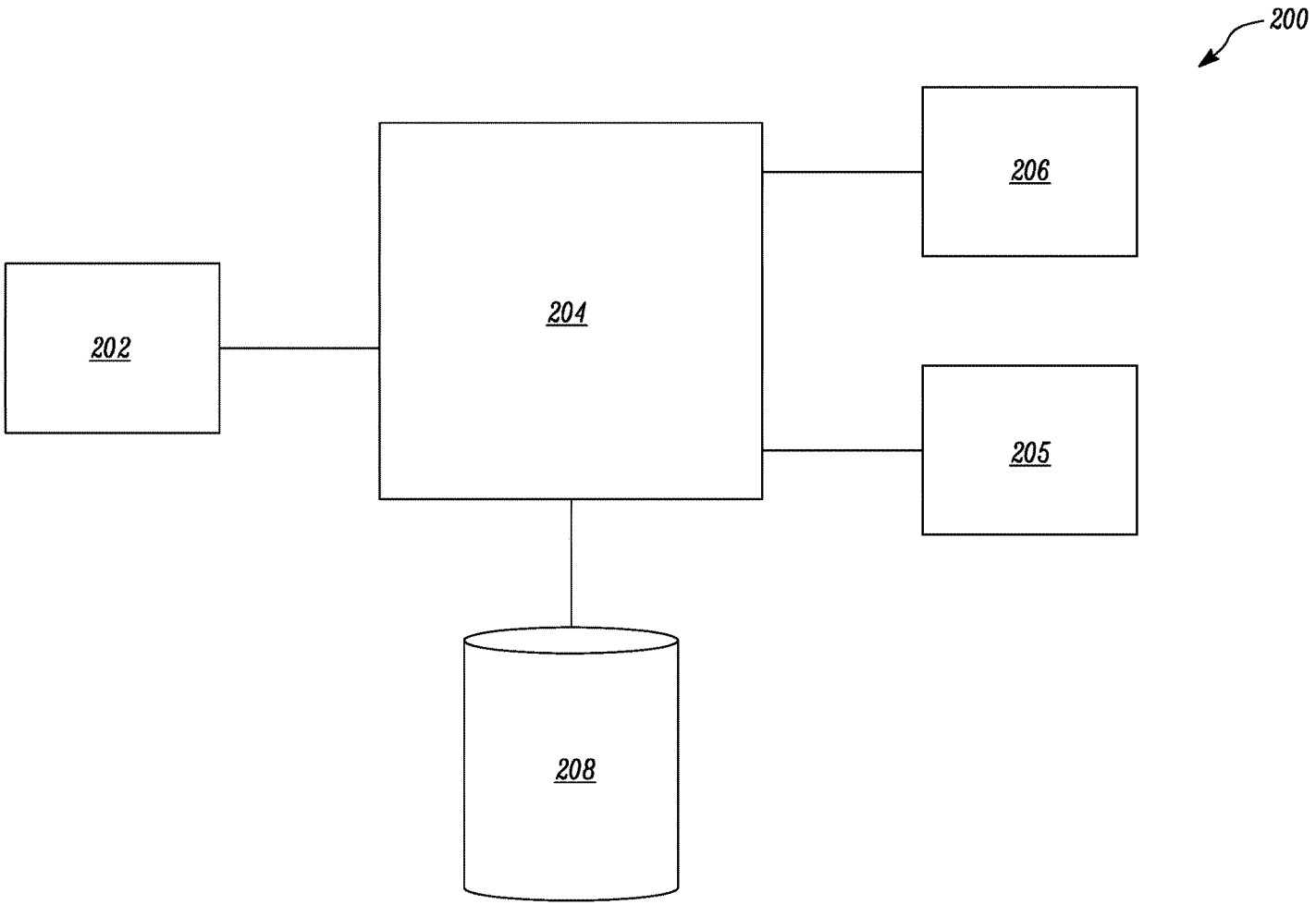
FIG. 2 is a block diagram of a swing control system, according to one embodiment of the present disclosure.

When the tracks 106 of the first machine 100 are static, the dipper 116 is operable to move based on three control actions, hoist, crowd, and swing. Hoist control raises and lowers the dipper 116 by winding and unwinding the hoist cable 122. Crowd control extends and retracts the position of the dipper handle 114 and the dipper 116. In one embodiment, the dipper handle 114 and the dipper 116 are crowded by using a rack and pinion system. In another embodiment, the dipper handle 114 and the dipper 116 are crowded using a hydraulic drive system. A swing control assembly 200 (see FIG. 2) swivels or swings the dipper handle 114 relative to the swing axis A-A'. During operation, an operator controls the dipper 116 to dig earthen material from a dig location, swing the dipper 116 to a dump location, release the dipper door 118 to dump the earthen material, and tuck the dipper 116, which causes the dipper door 118 to close, and swing the dipper 116 to the same or another dig location.

FIG. 1 also depicts the second machine 102. The second machine 102 is embodied as an exemplary haul truck 126. In the accompanying figures, a rear end of the haul truck 126 is illustrated on an exemplary basis. During operation, the first machine 100 dumps material contained within the dipper 116 into a bed 128 of the second machine 102 by opening the dipper door 118. Although the operation of the first machine 100 is described in combination with the haul truck 126, in other embodiments, the first machine 100 is also able to dump material from the dipper 116 into other material collectors, such as a mobile mining crusher or an in-pit-crushing and conveying (IPCC) system.

The present disclosure relates to the swing control assembly 200 for the first machine 100. The swing control assembly 200 includes a position detection module 202. The position detection module 202 is configured to generate a signal indicative of a relative position of the second machine 102 with respect to the first machine 100. In one embodiment, a first position detection module (not shown) is present on-board the second machine 102, such that the first position detection module includes an accelerometer, a gyroscope, a Global Positioning System (GPS), and/or a Global Navigation Satellite System (GNSS). In this case, the first position detection module may generate a signal indicative of a current position of the second machine 102. Further, the first machine 100 may include a second position detection module (not shown), configured to generate a signal indicative of a current position of the first machine 100. The second position detection module may receive the signal of the current position of the second machine 102 from the first position detection module. Further, the second position detection module may determine the relative position of the second machine 102 with respect to the first machine 100 based on both the position signals.

In another embodiment, the position detection module 202 may be present on-board the first machine 100. The position detection module 202 may embody a perception system including, but not limited to, a SONAR system, a LIDAR system, a camera system, ranging radios, and so on for detecting or sensing the relative position of the second machine 102 with respect to the first machine 100. In yet another embodiment, the position detection module 202 may be present at a remote location such as a control station that is located off-site. In this case, the position detection module 202 may determine the current positions of each of the first machine 100 and the second machine 102. Further, the position detection module 202 may transmit the relative position of the second machine 102 with respect to the first machine 100 for further processing by the first machine 100. Alternatively, the relative position of the second machine 102 with respect to the first machine 100 may be determined using any other known method.

The swing control assembly 200 also includes a controller 204. The controller 204 is communicably coupled to the position detection module 202. In one embodiment, the controller 204 is present on-board the first machine 100. In other embodiments, the controller 204 may be present at the remote location. The controller 204 may be in communication with a machine control unit (MCU) 205 on-board the first machine 100. The controller 204 receives the signal indicative of the relative position of the second machine 102 with respect to the first machine 100. Further, the controller 204 determines a direction of swing of the first machine 100 about the swing axis A-A' based on the relative position of the second machine 102 with respect to the first machine 100. A detailed description of this determination of the direction of swing will be explained later in this section.

Based on the determined direction of swing of the first machine 100, the controller 204 provides an instruction to initiate a swing operation of the first machine 100 about the swing axis A-A' for loading of the second machine 102. In one embodiment, the controller 204 is communicably connected to the MCU 205 of the first machine 100. Accordingly, the controller 204 issues a command to the MCU 205 to automatically control any one of a current swing operation or a next swing operation after completion of the current task being performed by the first machine 100. This automatic control of the swing operation allows for the controller 204 to initiate the swing operation or the next swing operation without any input or intervention from the operator of the first machine 100.

In another embodiment, the instruction provided by the controller 204 may be via an output device 206. In this case, the controller 204 is communicably coupled to the output device 206. The output device 206 may be present in the cab 110 of the first machine 100. The output device 206 may include any visual or auditory output device such as a screen, a monitor, a speaker, a touchscreen, and so on for providing a notification of the instruction to the operator. The output device 206 may be used to notify the operator of the direction of swing for the next swing operation of the first machine 100 so that the operator is given an indication of which direction to maneuver the first machine 100. For example, the notification may include a display message, an audible left/right, or a tone coming from a certain direction to provide the suitable indication to the operator.

Figure 3:
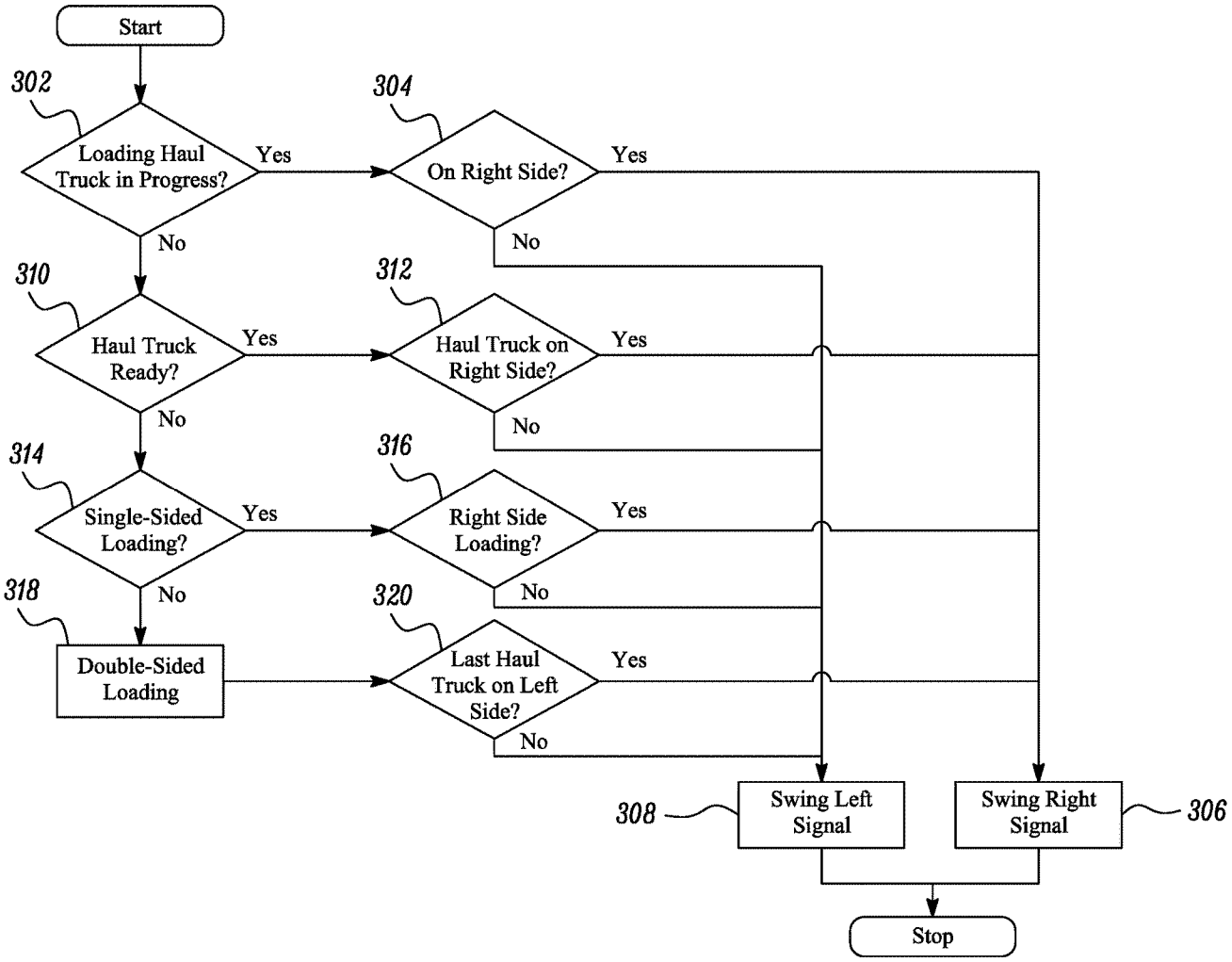
FIG. 3 is a flowchart of a method of operation of the swing control system, according to one embodiment of the present disclosure.

Referring to FIG. 3, a flowchart of a method 300 of the working of the swing control assembly 200 is illustrated. At step 302, the controller 204 receives a signal indicative of a current mode of operation from the first machine 100. In one embodiment, this signal of the current mode of operation is received from the MCU 205 of the first machine 100. The current mode of operation may include, for example, loading in progress, digging in progress, idle time, and so on. The controller 204 may receive this signal from the first machine 100 in order to determine that a current dig operation being performed by the first machine 100 is completed or that the first machine 100 is ready to perform the next loading operation. The controller 204 checks if the current mode of operation of the first machine 100 indicates that the loading of the second machine 102 is still in progress. For example, in case of the loading operation for the haul truck 106, the first machine 100 may need to make three to five passes in order to fill the bed 128 of the haul truck 126 to full capacity.

If the controller 204 determines that the current mode of operation of the first machine 100 is the loading in progress state, then the controller 204 proceeds to step 304. At step 304, the controller 204 determines a current direction of swing of the first machine 100. Accordingly, the controller 204 determines if the current loading operation of the second machine 102 is being performed on a right side of the first machine 100 or on a left side of the first machine 100. It should be noted that the terms "right side" and "left side" refer to diametrically opposite locations along a radius of rotation relative to the swing axis A-A' of the first machine 100. In one embodiment, this information related to the current direction of swing of the first machine 100 may be stored and retrieved by the controller 204 from a database 208 (see FIG. 2) associated with the first machine 100. The database 208 may be any data source, memory storage unit, or external repository known in the art.

Based on the determined direction of swing, the controller 204 initiates the instruction for the first machine 100 to perform the next swing operation in a same direction as that of the determined direction of swing. For example, if the current loading operation is being performed on the right side, the controller 204 proceeds to step 306 at which the controller 204 provides the instruction for initiating the next swing operation towards the right side of the first machine 100. Accordingly, the controller 204 may provide the instruction for swinging the dipper handle 114 in a clockwise direction about the swing axis A-A'. Alternatively, if the current loading operation is not being performed on the right side, which is the loading operation is being carried out on the left side, then the controller 204 proceeds to step 308 at which the controller 204 provides the instruction for initiating the next swing towards the left side of the first machine 100. In this case, the controller 204 may provide the instruction for swinging the dipper handle 114 in an anti-clockwise direction about the swing axis A-A'.

If the controller 204 determines at step 302 that the first machine 100 is currently not performing the loading operation, then the controller 204 proceeds to step 310. At step 310, the controller 204 receives a signal indicative of a current status of the second machine 102. For example, the second machine 102 may either be in a ready state or in a not ready state for loading by the first machine 100. In one embodiment, the controller 204 may receive the signal indicative of the current status of the second machine 102 from a machine control unit (not shown) on-board the second machine 102. In other embodiments, the controller 204 may determine if the second machine 102 is in the ready state based on the current position of the second machine 102 relative to a park zone for the loading operation to be performed. Alternatively, the current state of the second machine 102 may be determined by the controller 204 using any other known method.

If the controller 204 determines that the second machine 102 is in the ready state, the controller 204 proceeds to step 312. At step 312, the controller 204 determines the direction of swing of the first machine 100 based on the relative position of the second machine 102 with respect to the first machine 100 and the ready state of the second machine 102. Accordingly, the controller 204 determines the direction of swing of the first machine 100 for the loading operation to be performed. If the second machine 102 is found to be closer to the right side of the first machine 100, the controller 204 proceeds to step 306 for initiating the swing operation along the determined direction of swing, which is on the right side of the first machine 100. Alternatively, if the second machine 102 is positioned closer to the left side of the first machine 100, the controller 204 proceeds to step 308 for initiating the swing operation towards the left side of the first machine 100.

At step 310, if the controller 204 does not determine that the second machine 102 is in the ready state, the controller 204 proceeds to step 314. This situation may arise when the second machine 102 has not yet pulled back to the location that is desirable for the loading operation to be performed. Even in this case, the controller 204 may proceed to determine the direction of swing to ready the first machine 100 to perform the loading operation once the second machine 102 is positioned as desired.

Accordingly, at step 314, the controller 204 determines if the first machine 100 is performing single-sided loading. In single sided loading operation, the first machine 100 performs the next loading operation on the same side of the first machine 100 as that in a previous loading operation. For example, if the dipper handle 114 of the first machine 100 swung towards the right side to perform the loading operation, then in the subsequent or next swing loading to be performed by the first machine 100, the first machine 100 would again need to swing in the same direction.

If the controller 204 determines that the single-sided loading is being performed, then the controller 204 proceeds to step 316. In one embodiment, the selection of the single-sided loading operation may be based on an operator input provided through an input device on-board the first machine 100. At step 316, the controller 204 identifies the current direction of swing of first machine 100. The current direction of swing may be indicative of the side of the first machine 100 that the dipper handle 114 is swung towards to perform the current and/or previous loading operation. In one embodiment, this current direction of swing may be stored and retrieved from the database 208.

More specifically, at step 316, the controller 204 determines if the current direction of swing is towards the right side of the first machine 100. If so, the controller 204 proceeds to step 306, to initiate the next swing operation of the first machine 100 along the same direction, which is towards to the right side of the first machine 100. Else, the controller 204 proceeds to step 308 and issues a command to provide the instruction for initiating the next swing operation along the direction of the current direction of swing which is on the left side of the first machine 100.

Figure 4:
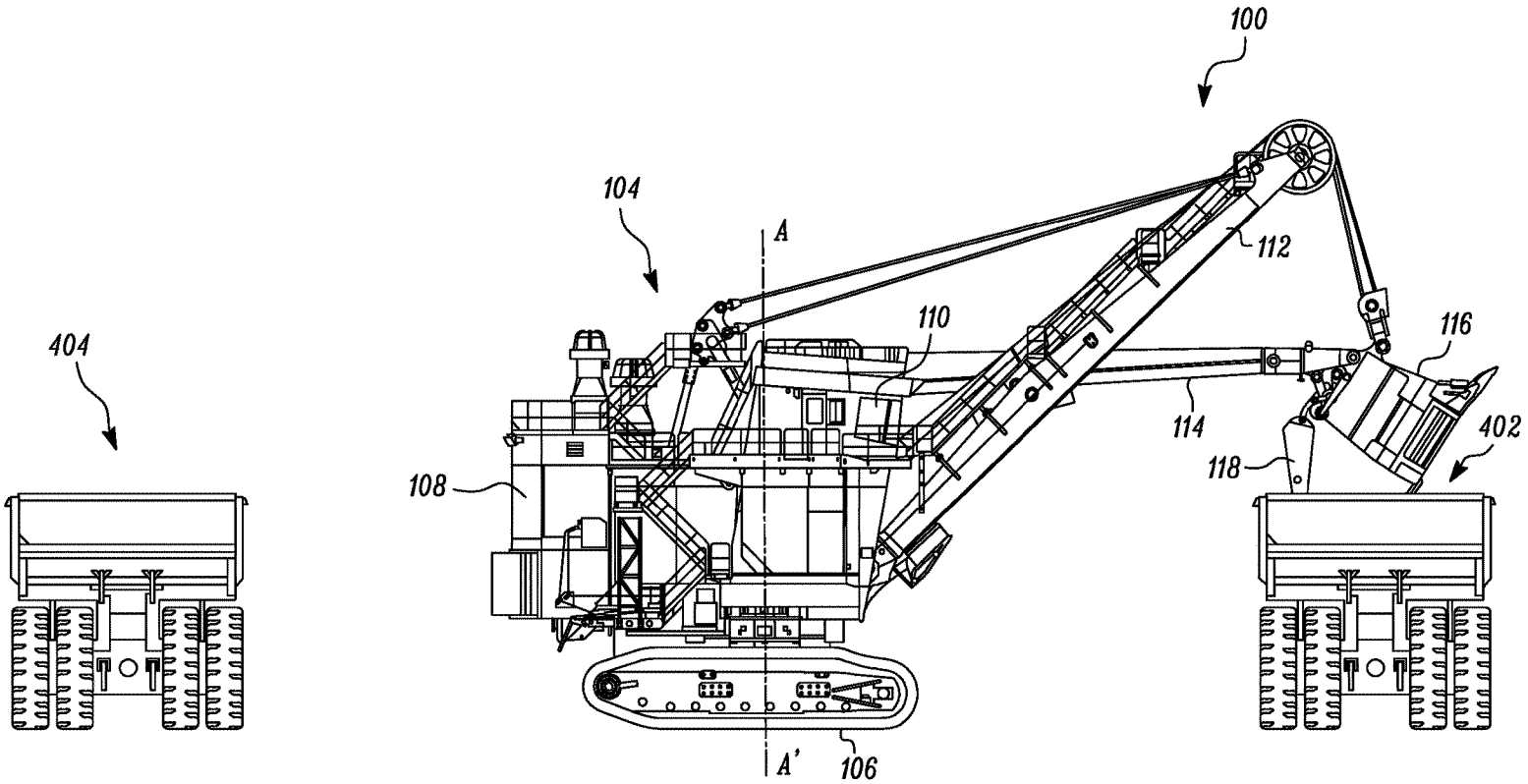
FIG. 4 is a side view of a first machine performing double sided loading, according to one embodiment of the present disclosure.

Alternatively, if the controller 204 determines that the single-sided loading operation is not being performed, at step 318 the controller 204 determines that the first machine 100 is performing the double-sided loading operation. In the double-sided loading operation, the first machine 100 alternatively swings towards the right side and then towards the left side thereof in consecutive loading operations performed by the first machine 100. Referring to FIG. 4, the double-sided loading operation is illustrated in which the first machine 100 initially swings to a first side, say for example towards the left side of the first machine 100 to load the haul truck 402. In the next swing operation, the first machine 100 subsequently swings to a second side, which will be towards right side in this case in order to load the haul truck 404 in the next swing and loading operation.

In one embodiment, the selection of the double-sided loading operation may be based on the operator input provided through the input device on-board the first machine 100. The controller 204 proceeds to step 320 at which the controller 204 identifies the current direction of swing of the first machine 100 in connection with the swing operation performed by the first machine 100 in the current and/or previous loading operation. In one embodiment, the current direction of swing may be stored and retrieved from the database 208. More specifically, at step 318, the controller 204 determines if the current direction of swing is towards the left side of the first machine 100. If so, the controller 204 proceeds to step 306, to initiate the next swing operation along the opposite direction, which is towards to the right side of the first machine 100. Else, the controller 204 proceeds to step 308 and issues a command to provide the instruction for initiating the next swing operation along the opposite direction of the current direction of swing which is on the left side of the first machine 100. A person of ordinary skill in the art will appreciate that the sequence of the steps may vary and is not limited to that described herein.

Further, the controller 204 may embody a single microprocessor or multiple microprocessors. Numerous commercially available microprocessors can be configured to perform the functions of the controller 204. The controller 204 may include all the components required to run an application such as, for example, a memory, a secondary storage device, and a processor, such as a central processing unit or any other means known in the art. Various other known circuits may be associated with the controller 204, including power supply circuitry, signal-conditioning circuitry, communication circuitry, and other appropriate circuitry.

INDUSTRIAL APPLICABILITY

Figure 5:
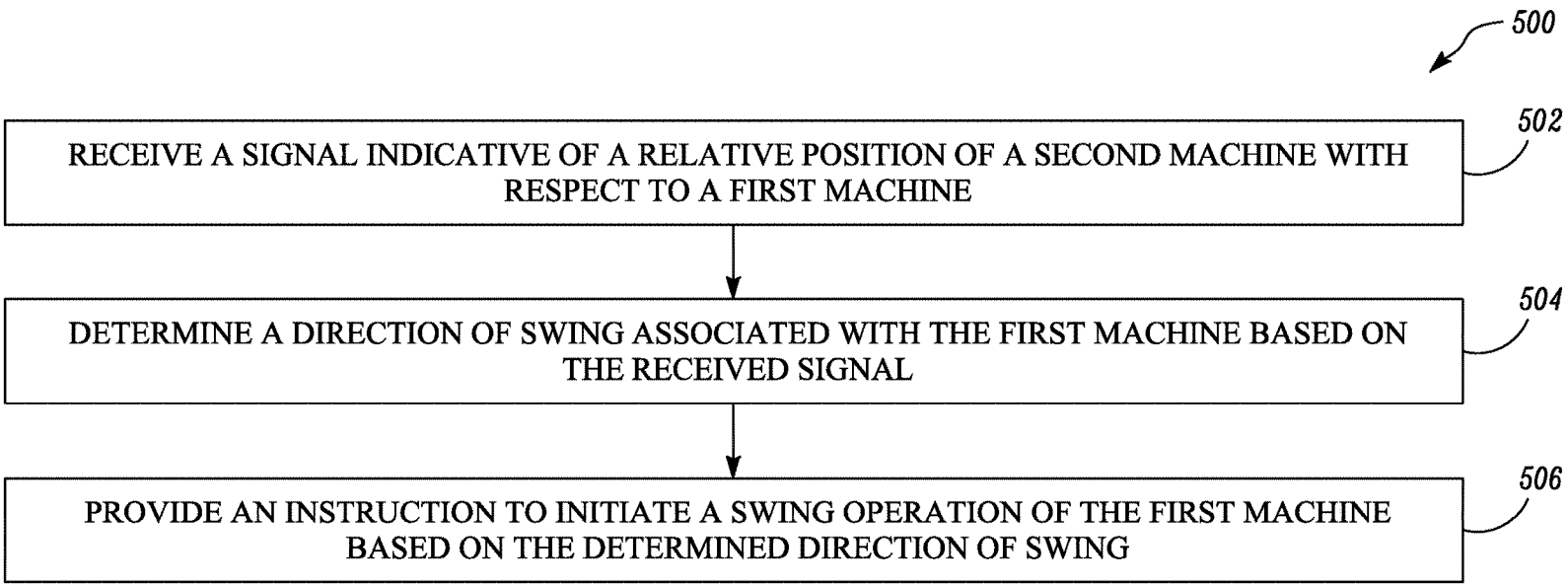
FIG. 5 is another flowchart of a method of working of the swing control system, according to one embodiment of the present disclosure.

The present disclosure relates to the swing control assembly 200 and working thereof. Referring to FIG. 5 a method 500 of controlling the swing operation of the first machine 100 is illustrated. At step 502, the controller 204 receives the signal indicative of the relative position of the second machine 102 with respect to the first machine 100 from the position detection module 202. At step 504, the controller 204 determines the direction of swing associated with the first machine 100 based on the received signal. At step 506, the controller 204 provides the instruction to initiate the swing operation of the first machine 100 based on the determined direction of swing.

The swing control assembly 200 automatically determines the direction of swing of the first machine 100 without requiring any input from the operator of the first machine 100. The swing control assembly 200 considers a number of factors including, but not limited to, if the loading operation is being performed by the first machine 100, if the second machine 102 is in a ready state, and the relative location of the second machine 102 with respect to the first machine 100 for determining the direction of swing of the current or next swing operation of the first machine 100. The swing control assembly 200 can be utilized in both single as well as double-sided loading applications. Accordingly, the direction of swing that is determined by the swing control assembly 200 may either be in the same direction or in the opposite direction of the previous swing operation of the dipper handle 114 about the swing axis A-A'.

Since the swing control assembly 200 does not require any operator input, the swing control assembly 200 provides a robust solution that effectively performs consecutive swing operations in a timely manner. Further, the swing control assembly 200 provides an automated solution having less reliance on the operator of the first machine 100, thereby improving overall productivity of the system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A swing control assembly for a first machine, the swing control assembly comprising:

a position detection module configured to generate a signal indicative of a relative position of a second machine with respect to the first machine; and a controller communicably coupled to the position detection module, the controller configured to:

receive the signal indicative of the relative position of the second machine with respect to the first machine;

determine a direction of swing associated with the first machine based on the received signal of the relative position of the second machine with respect to the first machine;

provide an instruction to initiate a swing operation of the first machine based on the direction of swing;

determine if a loading operation is in progress by the first machine;

identify a current direction of swing of the first machine if the loading operation is in progress; and provide, if the loading operation is in progress, an instruction to initiate a next swing operation of the first machine in a same direction as the current direction of swing.

2. The swing control assembly of claim 1, wherein the position detection module includes a position detection sensor provided on the second machine, and wherein the position detection sensor is configured to generate a signal indicative of a current position of the second machine.

3. The swing control assembly of claim 2, wherein the position detection sensor includes at least one of a global positioning system, an accelerometer, or a gyroscope.

4. The swing control assembly of claim 1, wherein the position detection module includes a perception sensor provided on the first machine, and wherein the perception sensor is configured to sense the relative position of the second machine with respect to the first machine.

5. The swing control assembly of claim 1, wherein the controller is communicably coupled to a machine control unit of the first machine, and wherein the controller is configured to provide the instruction to the machine control unit to automatically initiate the swing operation.

6. The swing control assembly of claim 1, wherein the controller is communicably coupled to an output unit, and wherein the controller is configured to provide the instruction to an operator through the output unit.

7. The swing control assembly of claim 1, wherein the controller is further configured to:

receive a signal indicative of a current mode of operation of the first machine, and wherein, when determining if the loading operation is in progress, the controller is configured to:

determine if the loading operation is in progress based on the received signal of the current mode of operation of the first machine.

8. The swing control assembly of claim 1, wherein the controller is further configured to:

receive a signal indicative of a current status of the second machine; and determine if the second machine is in a ready state based on the received signal of the current status, wherein, when determining the direction of swing of the first machine, the controller is configured to:

determine the direction of swing of the first machine based on the relative position of the second machine with respect to the first machine and the ready state of the second machine, and wherein, when providing the instruction to initiate the swing operation of the first machine, the controller is configured to:

provide the instruction to initiate the swing operation of the first machine along the determined direction of swing.

9. The swing control assembly of claim 1, wherein the controller is further configured to:

determine if the first machine is performing a single-sided loading operation;

identify another current direction of swing of the first machine if the first machine is performing the single-sided loading operation; and provide another instruction to initiate another next swing operation of the first machine in a same direction as the other current direction of swing.

10. The swing control assembly of claim 1, wherein the controller is further configured to:

determine if the first machine is performing a double-sided loading operation;

identify another current direction of swing of the first machine if the first machine is performing the double-sided loading operation; and provide another instruction to initiate another next swing operation of the first machine in an opposite direction from the other current direction of swing.

11. A method for controlling a swing of a first machine, the method comprising:

receiving, by a controller, a signal indicative of a relative position of a second machine with respect to the first machine;

determining, by the controller, if the second machine is in a ready state;

determining, by the controller and if the second machine is in the ready state, a direction of swing of the first machine based on the relative position of the second machine with respect to the first machine and the ready state; and providing, by the controller, an instruction to initiate a swing operation of the first machine based on the determined direction of swing.

12. The method of claim 11 further comprising:

receiving, by the controller, a signal indicative of a current mode of operation of the first machine;

determining, by the controller, if a loading operation is in progress based on the current mode of operation of the first machine;

identifying, by the controller, a current direction of swing of the first machine if the loading operation is in progress; and providing, by the controller and if the loading operation is in progress, an instruction to initiate a next swing operation of the first machine in a same direction as the current direction of swing.

13. The method of claim 11, further comprising:

receiving, by the controller, a signal indicative of a current status of the second machine, where determining if the second machine is in the ready state comprises:

determining, by the controller, if the second machine is in the ready state based on the current status of the second machine.

14. The method of claim 11, further comprising:

determining, by the controller, if the first machine is performing a single-sided loading operation;

identifying, by the controller, a current direction of swing of the first machine if the first machine is performing the single-sided loading operation; and providing, by the controller, an instruction to initiate a next swing operation of the first machine in a same direction as the current direction of swing.

15. The method of claim 11, further comprising:

determining, by the controller, if the first machine is performing a double-sided loading operation;

identifying, by the controller, a current direction of swing of the first machine if the first machine is performing the double-sided loading operation; and providing, by the controller, an instruction to initiate a next swing operation of the first machine in an opposite direction from the current direction of swing.

16. A machine comprising:

an engine; and a swing control assembly comprising:

and a controller configured to:

determine if the machine is performing a single-sided loading operation or a double-sided loading operation;

identify a current direction of swing of the machine if the machine is performing the single-sided loading operation or the double-sided loading operation; and provide an instruction to initiate a swing operation based on the current direction of swing.

17. The machine of claim 16, wherein the controller is communicably coupled to a machine control unit of the machine, and wherein the controller is configured to provide the instruction to the machine control unit to automatically initiate the swing operation.

18. The machine of claim 16, wherein the controller is communicably coupled to an output unit, and wherein the controller is configured to provide the instruction to an operator through the output unit.

19. The machine of claim 16, wherein, when determining if the machine is performing the single-sided loading operation or the double-sided loading operation, the controller is configured to:

determine if the machine is performing the single-sided loading operation, wherein, when identifying the current direction of swing of the machine if the machine is performing the single-sided loading operation or the double-sided loading operation, the controller is configured to:

identify the current direction of swing of the machine if the machine is performing the single-sided loading operation, and wherein, when providing the instruction to initiate the swing operation, the controller is configured to:

provide the instruction to initiate the swing operation of the machine in a same direction as the current direction of swing.

20. The machine of claim 16, wherein, when determining if the machine is performing the single-sided loading operation or the double-sided loading operation, the controller is configured to:

determine if the machine is performing the double-sided loading operation, and wherein, when identifying the current direction of swing of the machine if the machine is performing the single-sided loading operation or the double-sided loading operation, the controller is configured to:

identify the current direction of swing of the machine if the machine is performing the double-sided loading operation; and wherein, when providing the instruction to initiate the swing operation, the controller is configured to:

provide the instruction to initiate the swing operation of the machine in an opposite direction from the current direction of swing.

* * * * *